United States Patent [19]

Ferkl et al.

[11] 4,429,522

[45] Feb. 7, 1984

[54] OPEN-END SPINNING MACHINE

[75] Inventors: František Ferkl; Antonín Cap; Milos Vecera; Josef Skála; Vaclav Kopriva; Michal Blasko, all of Usti nad Orlici; Karel Pavek, Hnatnice; Milan Chrtek, Ceska Trebova; Jan Blasko, Usti nad Orlici, all of Czechoslovakia

[73] Assignee: Vyzkumny ustav bavlnarsky, Usti nad Orlici, Czechoslovakia

[21] Appl. No.: 358,887

[22] Filed: Mar. 17, 1982

[30] Foreign Application Priority Data

Apr. 13, 1981 [CS] Czechoslovakia ..... 2773-81

[51] Int. Cl.[3] ..... D01H 7/888

[52] U.S. Cl. ..... 57/301; 57/411

[58] Field of Search ..... 57/301, 302, 304, 305, 57/411

[56] References Cited

U.S. PATENT DOCUMENTS

| | | | |
|---|---|---|---|
| 3,763,641 | 10/1973 | Doudlebsky et al. | 57/301 |
| 3,892,063 | 7/1975 | Doudlebsky et al. | 57/301 |
| 4,041,687 | 8/1977 | Motobayashi et al. | 57/301 |
| 4,249,370 | 2/1981 | Vecera et al. | 57/301 |

*Primary Examiner*—John Petrakes

[57] ABSTRACT

An open-end spinning machine having an open-end spinning unit with novel apparatus for withdrawing impurities released in the spinning unit. An impurity releasing duct outlet of the sliver separation housing of the open-end spinning unit extends from said housing and has substantially the same cross-sectional inner height dimensions as those of the cleaning aperture, while a connecting tube inlet joined to said outlet is substantially conically flared, a gap being provided between said outlet and said inlet for the sucking-in of additional air.

4 Claims, 3 Drawing Figures

OPEN-END SPINNING MACHINE

This invention relates to an open-end spinning machine, and is particularly related to an open-end spinning machine which solves the problem of withdrawing impurities released in the spinning unit of such machine.

An open-end spinning machine comprising a plurality of spinning units, each consisting of a spinning housing and a fiber separation housing which are arranged tiltable from each other, is known, for example, in the German DE-AS No. 1,535,005. Further, according to German DE-AS No. 2,023,234 and German DE-OS No. 2,327,663 there is known an arrangement of a cleaning aperture in the fiber separation housing, such aperture being followed by an impurity withdrawing duct communicating by its outlet via a connecting tube with the central air withdrawing duct which is supported in or on the machine frame. The spinning housing also communicates with the central air withdrawing duct, which can be either separate or can serve simultaneously for withdrawing technological air from the spinning rotor. Outlets of the ducts leading from the spinning and the fiber separation housings are connected to inlets of the connecting tubes of the central air withdrawing ducts on the wall of the machine frame.

One of the numerous problems to be coped with in the operation of the open-end spinning machine is the problem of withdrawing impurities. One of such problems consists in withdrawing impurities from the cleaning aperture through a withdrawing duct in which complicated air flows prevail so that impurities may return back to the sliver opening cylinder. This problem has been solved in manners disclosed in many patents. Thus, for instance, it is known in German DE-OS No. 2,327,663 to provide a cleaning aperture and a withdrawing duct which are followed by an impurity collecting chamber. In the bottom part of such chamber, below the level of the withdrawing duct opening, there is provided an ejecting duct communicating at last with the central withdrawing duct. Another arrangement has been disclosed in Swiss Patent Specification No. 593,355, U.S. Pat. No. 4,249,370 wherein the cleaning aperture and the withdrawing duct communicate with a foreign air duct into which impurities are ejected and thus withdrawn into the central air duct.

A complexity of air flows which, apart from other reasons, is caused by the fact that the walls of the withdrawing duct are variously inclined and in most cases converge, is responsible for the return of a portion of the impurities. Such portion returns not only from the collecting chamber, as shown in the above-mentioned German DE-OS No. 2,327,663, but also from the foreign air duct disclosed in the afore-mentioned Swiss Patent Specification No. 593,355, since this duct also tapers in the impurity flow direction.

Another problem arises at the outlets of said ducts in the region where they are connected to the inlets of connecting tubes through which said ducts communicate with the central air duct. When the spinning unit is being opened, the spinning housing and the fiber separation housing become spaced apart from said inlets. Although in the central air duct a permanent sub-atmospheric pressure prevails, there arise, during the opening of the spinning unit, whirls of dust and fibers deposited in the environment of the spinning unit; such whirls are caused, for instance, by the escape of air from the spinning housing before the spinning rotor has come to a stop. During the re-closing of the spinning unit, fibers become clamped between the outlets and inlets of said ducts, which may cause said outlets and inlets to become blocked, or results at least in a reduction of the efficiency of impurity ejection and withdrawal from the fiber separation housing. Attempts to solve this problem have been made, for example, in the Czechoslovakian Inventor's Certificate No. 165,891, wherein the outlet of a withdrawing tube has been shown as narrowed in the region of joining a connecting duct, and is provided with a sealing element. Although the sealing of said region has been known and used in practice (see e.g. DE-OS No. 22 94 255), it is not free of the above-outlined drawbacks. Apart from this, because of the tiltable arrangement of the two housings, it is always necessary to maintain a high degree of accuracy in the manufacture of the spinning units and the machine frames.

It is an object of the present invention, on the one hand, to solve the problem of withdrawing impurities from the cleaning aperture through the withdrawing duct so that their return is impossible, and, on the other hand, to prevent them from being re-captured in the transition region between the outlets from the spinning unit and the inlets into the central air duct while maintaining the manufacturing and assembling simplicity of the open-end spinning machine.

In accordance with one feature of the invention, the outlet of the impurity withdrawing duct extends toward the outer wall of the fiber separation housing to a height corresponding to the height of the cleaning aperture, the connecting tube having a conically flared inlet facing the outlet in the outer wall of said fiber separation housing, and having in the inlet plane a larger inner cross-section than the outer cross-section of the outlet, there being provided a gap for additionally sucking in air between the inlet of the connecting tube and said outlet.

In a more preferable embodiment the outlet of the impurity withdrawing duct projects out of the outer wall of the fiber separation housing, and the outer peripheral wall of said outlet is conically flared from the outlet end portion to the outer wall of said fiber separation housing, the connecting tube, in the operating position of the housing, being drawn over said outer peripheral wall of the outlet.

According to another feature of the invention, the end portion of the outlet in the outer wall of the fiber separation housing and the technological air withdrawing aperture in the spinning housing are located in two different planes spaced apart from each other at a distance which is larger than the axial spacing between said outlet and said air withdrawing aperture.

To provide for manufacturing and assembling simplicity, the connecting tube is fixed to an elastic sleeve provided in the wall of the central air withdrawing duct, and extends through a hole in the wall of the frame and through a holder adjustably attached to the outer wall of the frame.

It is an advantage of the invention that the impurity withdrawing duct following the cleaning aperture has substantially the same cross-sectional height as said aperture, so that the influence of its walls upon the impurity return to the sliver opening cylinder is substantially suppressed. Another advantage is that no fiber recapture occurs in the transition region between the outlets and the inlets, whereby said region is prevented from being choked since the additionally sucked-in air carries along a random fiber fly from the spinning mill atmosphere when the spinning unit is being re-closed. Due to a displacement of the impurity withdrawing duct outlet in the sliver separation housing relative to the aperture for withdrawing technological air from the spinning housing, the unwanted influence of air flow ejected from the spinning housing is eliminated.

In order that the present invention be better understood and carried into practice, some preferred embodiments thereof will hereinafter be described with reference to the accompanying drawings, in which.

Figure 1:
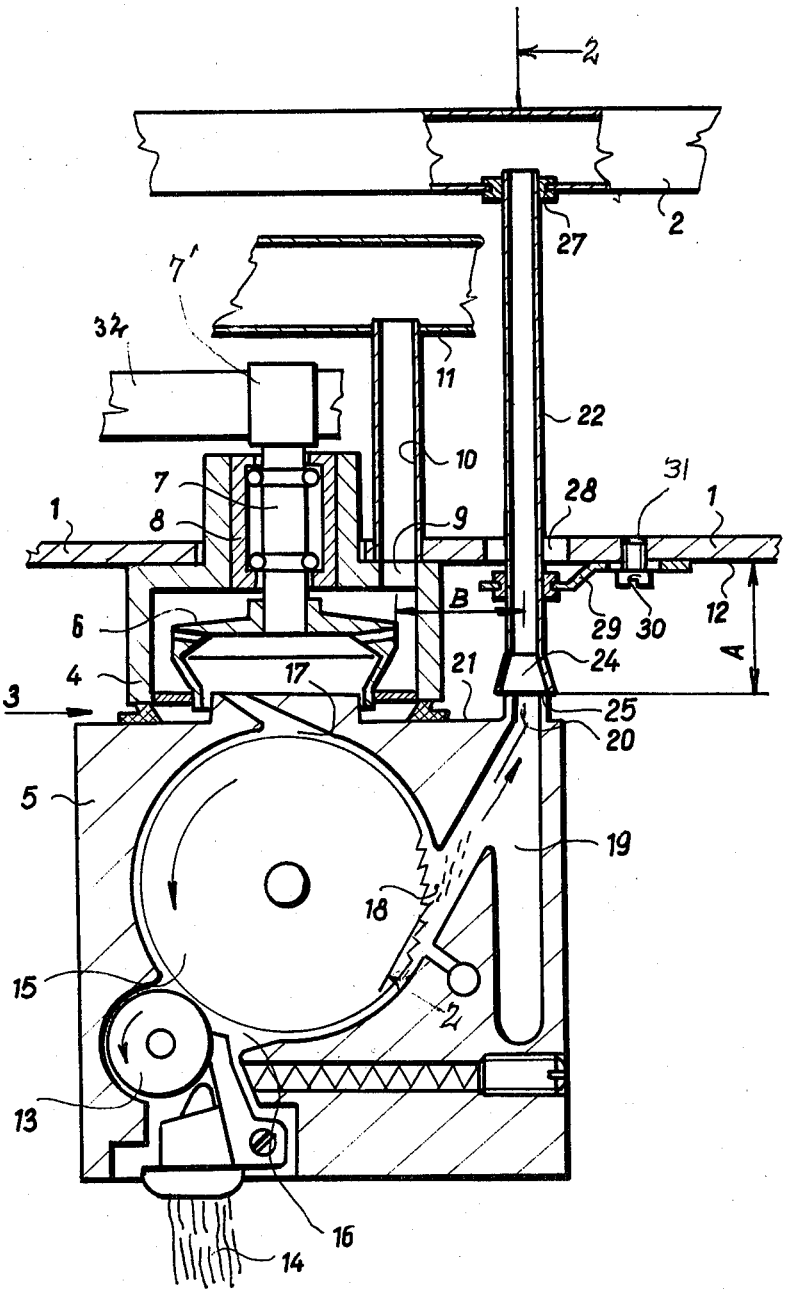
FIG. 1 is a view in cross-section of an open-end spinning unit wherein the connection thereof to a central air withdrawing duct is shown.

Turning first to FIG. 1 of the drawings, the open-end spinning unit thereshown has a frame 1 with a central air withdrawing duct 2. Duct 2 extends along the entire multi-unit machine, and its outlet is connected to a suction duct of the spinning mill, or to a separate sub-atmospheric pressure source. At its outer side, the frame 1 supports a plurality of known spinning units 3 each of which has a spinning housing 4 and a fiber separating housing 5. In the spinning housing there is a known spinning rotor 6 mounted on a shaft 7 which is journaled in a bearing bushing 8. The spinning rotor 6 is either provided with ventilation holes, or a necessary sub-atmospheric pressure in its interior is produced by a sub-atmospheric pressure source which is common to all of the spinning units. However, the spinning housing 4 is always provided with an aperture 9 for expelling technological or operating air therefrom.

In the operative or closed position of the spinning unit 3, the aperture 9 communicates with the inlet of a connecting duct 10 followed by a through duct 11 for withdrawing the operating air. The aforesaid inlet of the connecting duct 10 opens at the outer side 12 of the frame 1. In the fiber separation housing 5 there are provided a feeding mechanism 13 for supplying a fiber sliver 14, and a sliver opening cylinder 15 which is driven by a belt (not shown). Out of the cavity 16 of the fiber separating housing 5 in which the opening cylinder 15 is received, there extend, on the one hand, a supply duct 17 for supplying separated fibers into the spinning rotor 6, and, on the other hand, a cleaning aperture 18 followed by a withdrawing duct 19, the outlet 20 of which projects from the outer wall 21 of the fiber separation housing 5.

Within its entire length, which means from the cleaning aperture 18 up to the outlet 20, the withdrawing duct 19 has one and the same inner height dimension H of cross-section. The outlet 20 communicates through a connecting tube 22 with the central air withdrawing duct 2 for withdrawing impurities. The inlet 24 of said connecting tube 22 is substantially conically flared and opens at the outer wall 21 of the fiber separation housing 5, facing the outlet 20 of the impurity withdrawing duct 19. The inner cross-section of the inlet 24 of the connecting duct 22 is larger than that of said outlet 20, there being provided a gap 25 between said inlet 24 and said outlet 20 for sucking-in additional air. The outlet 20 projects from the outer wall 21 of the fiber separation housing 5, the peripheral outer wall 26 of said outlet 20 being substantially conically tapered so as to widen from its free end portion to said outer wall 21 of the fiber separation housing 5. By its conically flared inlet 24, the connecting tube 22 is drawn, at least partially, over said tapered outer wall 26 of the outlet 20, when the spinning unit 3 is in its closed or operating condition. The conically flared inlet 24 of the connecting tube 22 can be provided with short protuberances to form a gap between said walls, or to the contrary, such protuberances can be provided on the outer wall 26 of the outlet 20.

Alternatively, it is also possible to connect the inlet 24 to the outlet 20 without any projections, and to leave the formation of the gap 25 in dependence upon an inaccuracy in manufacture, such as, for example, unmachined cast pieces. The connecting tube 22 is fixed in an elastic sleeve 27 provided in the wall of the central air withdrawing duct 2, extends through a hole 28 in the wall of the frame 1, and further through a holder 29 adjustably attached to the outer side 12 of said frame, as for instance, by means of a screw 30 extending through a slot 31 in the holder 29. By means of said holder 29 it is possible easily to position the inlet 24 of the connecting tube 22 to face the outlet 20 of the impurity withdrawing duct 19, and thus to compensate for any imprecision in the manufacture of the parts. To prevent an unwanted interaction of air flows in the opened or inoperative condition of the spinning unit, or during the opening of such unit, the plane comprising the end portion of the outlet 20 in the fiber separation housing 5 is spaced apart a distance A from the plane in which the operating air withdrawing aperture 9 lies in the spinning housing 5, said distance A being larger than the axial spacing B between said outlet 20 and said aperture 9. The above-described exemplary embodiment insures a continuous withdrawal of impurities from the cleaning aperture 18 of the fiber separation housing 5 into the central air withdrawing duct 2.

Figure 2:
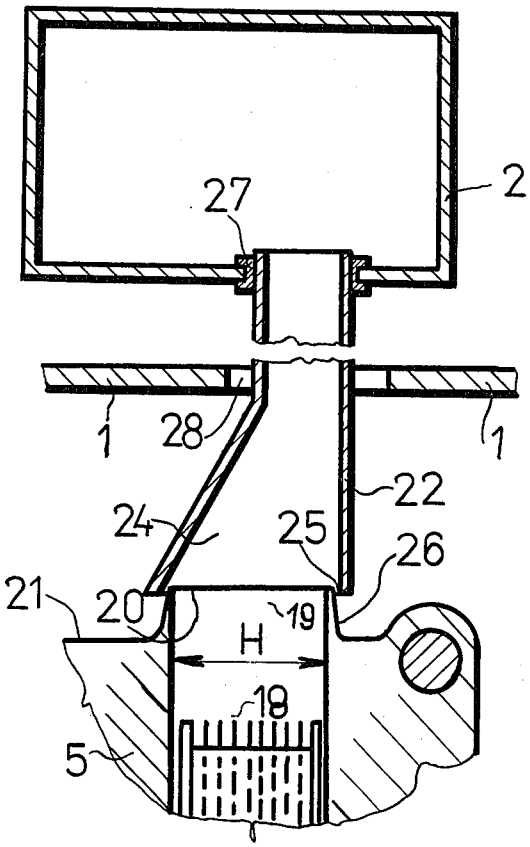
FIG. 2 is a view in section through the spinning unit in FIG. 1, the section being taken along the line 2—2 in FIG. 1, FIG. 2 showing the cross-sectional dimension H of the impurity withdrawing duct.
Figure 3:
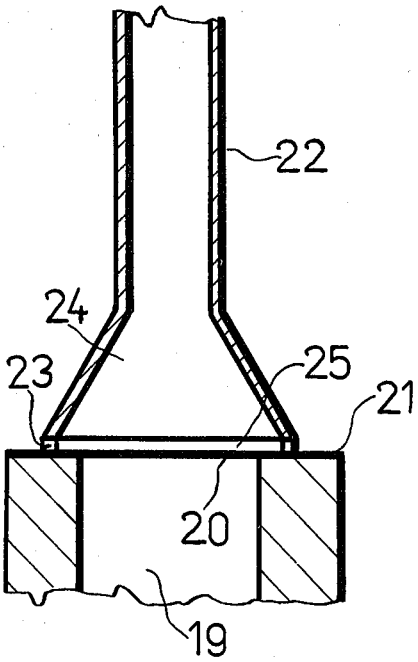
FIG. 3 is a view similar to FIG. 2 showing an alternative embodiment of the connection between the withdrawing duct outlet and the connecting tube inlet.

In the embodiment of FIG. 3, wherein the same reference characters are employed to designate elements which are similar to those of FIGS. 1 and 2, the gap 25 can be, for example, constituted by three short projections 23 which are outstanding from the edge of the inlet 24 of the connecting tube 22 and are circumferentially spaced apart from one another, as shown.

In operation, the spinning rotor 6 is driven by a belt 32 which engages a pulley 7' on the top of the shaft 7. A fiber sliver 14 is supplied by the feeding mechanism 13 to the fiber opening cylinder 15 by which individual fibers are separated and conveyed into the supply duct 17. Through the latter the fibers are transported by air flow into the spinning rotor 6 in which they are deposited in a known manner to form a fiberous ribbon which is then converted to yarn by rolling or twisting. The yarn is withdrawn from the spinning rotor either in a downward direction as shown in the co-assigned patent to Ripka et al., U.S. Pat. No. 4,251,984, or upwardly through a hollow shaft bearing the spinning rotor, as in the co-assigned patent to Mikulecky et al., U.S. Pat. No. 4,246,749. The air flow is generated by a sub-atmospheric air pressure produced in the spinning rotor 6 by means of well-known ventilation holes provided in the rotor. Air is withdrawn from the spinning rotor 6 through the connecting duct 10 into the through-duct 11 provided in the machine frame 1.

In the fiber separating process effected by the opening cylinder 15, impurities are simultaneously released and are then ejected through the cleaning aperture 18 into the withdrawing duct 19. Since the withdrawing duct 19 communicates via connecting tube 22 with the central air withdrawing duct 2 in which a sub-atmospheric pressure is produced by a source (not shown), there arises, due to a pressure gradient, an air flow in the direction from the withdrawing duct 19 to the central air withdrawing duct 2.

Impurities which are hurled off by the opening cylinder 15 into the cleaning aperture 18, are then conveyed by said flow from the withdrawing duct 19, via the connecting tube, to the central air withdrawing duct 2. In the region where the inlet 24 of the connecting tube 22 joins the outlet 20 of the withdrawing duct at the outer wall 21 of the fiber separating housing 5, additional air is sucked in through the gap 25 in order to prevent fibers from being deposited in this region during the manipulation of the spinning unit when the latter is being opened in a known manner, as for instance, after a yarn breakage in the spinning rotor 6.

Although the invention is illustrated and described with reference to a plurality of embodiments thereof, it is to be expressly understood that it is in no way limited to the disclosure of such preferred embodiments but is capable of numerous modifications within the scope of the appended claims.

We claim:

1. In an open-end spinning machine having a frame, a central air withdrawing duct disposed on one side of the frame, a plurality of spinning units disposed on the other side of the frame, each spinning unit having a spinning housing with a spinning rotor and a technological air withdrawing aperture, and a fiber separating housing with a sliver opening cylinder and an associated cleaning aperture with an impurity withdrawing duct the outlet of which communicates via a connecting tube with the central air withdrawing duct, the improvement wherein the outlet of the impurity withdrawing duct extends toward the outer wall of the fiber separating housing and has an inner height dimension substantially corresponding to the inner height dimension of the cleaning aperture, said latter height dimension being given by the width of the sliver opening cylinder, the connecting tube having a conically flared inlet facing the outlet of the impurity withdrawing duct in the outer wall of the fiber separating housing and having in the plane of the inlet of the connecting tube a larger inner cross-section than the outer cross-section of the outlet of the impurity withdrawing duct, there being provided a gap for additionally sucking in air between said inlet of the connecting tube and the outlet, the end plane of the outlet of said impurity withdrawing duct on the fiber separating housing being spaced a distance from the plane in which the operating air withdrawing aperture lies in the spinning housing which is larger than the axial spacing between said outlet and said aperture, whereby to prevent an unwanted interaction of air flows in the opened and inoperative condition of the spinning unit and to insure a continuous withdrawal of impurities from the cleaning aperture of the fiber separating housing into the central air withdrawing duct.

2. An open-end spinning machine as claimed in claim 1, wherein the outlet of the impurity withdrawing duct projects out of the outer wall of the fiber separation housing, and the outer peripheral wall of said outlet is conically flared from the outlet end portion to the outer wall of said fiber separation housing, the connecting tube in the operating position of the housing being drawn over said outer peripheral wall of the outlet.

3. An open-end spinning machine as claimed in claim 1, wherein the end portion of the outlet in the outer wall of the fiber separation housing and the technological air withdrawing aperture in the spinning housing lie in two different planes spaced apart from each other by a distance which is larger than the axial spacing between said outlet and said air withdrawing aperture.

4. An open-end spinning machine as claimed in claim 1, wherein the connecting tube is fixed in an elastic sleeve provided in the wall of the central air withdrawing duct, and extends through a hole in the wall of the frame and through a holder adjustably attached to the outer side of the frame.

* * * * *